US010443967B1

(12) United States Patent
Rose et al.

(10) Patent No.: US 10,443,967 B1
(45) Date of Patent: Oct. 15, 2019

(54) DRIVE MECHANISM AND SYSTEM FOR REMOTELY OPERATING A TURRET

(71) Applicant: LOCKHEED MARTIN CORPORATION, Bethesda, MD (US)

(72) Inventors: Craig Matthew Rose, Mansfield, TX (US); Ronald Eugene Janka, Colleyville, TX (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 0 days.

(21) Appl. No.: 15/685,023

(22) Filed: Aug. 24, 2017

Related U.S. Application Data

(62) Division of application No. 14/296,381, filed on Jun. 4, 2014, now Pat. No. 9,746,270.

(51) Int. Cl.
*F41A 27/28* (2006.01)
*F41G 3/22* (2006.01)

(52) U.S. Cl.
CPC ..... *F41A 27/28* (2013.01); *F41G 3/22* (2013.01)

(58) Field of Classification Search
CPC ..... F41A 23/00; F41A 23/02; F41A 23/24; F41A 23/56; F41A 27/00; F41A 27/06; F41A 27/18–24; F41A 27/28; F41G 3/22
USPC ..... 89/37.11–37.13, 40.03–40.04, 89/41.01–41.02
See application file for complete search history.

(56) References Cited

U.S. PATENT DOCUMENTS 2,356,152 A 8/1944 Edwards et al.
2,364,425 A 12/1944 Corte
2,389,451 A 11/1945 Moynihan
2,392,851 A 1/1946 Kasch
2,480,136 A 8/1949 Holstein
2,576,085 A 11/1951 Vivian
2,660,794 A 12/1953 Goertz et al.
2,712,271 A 7/1955 Wabnitz
2,775,139 A 12/1956 Leathers et al.
2,803,170 A 8/1957 Black
2,805,603 A 9/1957 Musser
3,309,962 A 3/1967 Lykam
3,429,222 A 2/1969 Whiston et al.
3,840,074 A 10/1974 Clark
4,019,422 A 4/1977 Magnuson
(Continued)

FOREIGN PATENT DOCUMENTS

EP 0 313 759 5/1989

*Primary Examiner* — Stephen Johnson
*Assistant Examiner* — Benjamin S Gomberg
(74) *Attorney, Agent, or Firm* — Terry M. Sanks, Esq.; Beusse Wolter Sanks & Maire, PLLC

(57) ABSTRACT

An unmanned turret having a turret ring gear and first and second electrical force-producing devices with the unmanned turret being rotatably mounted to a vehicle chassis, the turret drive mechanism including at least one ring gear independent of the turret ring gear, at least one manually-operable input component rotatably coupled to the at least one ring gear, the at least one input component accessible within the vehicle chassis, and at least one output component mechanically coupled to at least one of the first and second electrical force-producing devices of the unmanned turret to cause rotation of the at least one of the first and second electrical force-producing device. Another turret drive mechanism and an unmanned turret are also disclosed.

16 Claims, 5 Drawing Sheets

(56) References Cited

U.S. PATENT DOCUMENTS

| | | | | |
|---|---|---|---|---|
| 4,353,283 | A | 10/1982 | Crepin | |
| 4,382,216 | A | 5/1983 | Joseph | |
| 4,523,487 | A | 6/1985 | Pietzsch et al. | |
| 4,527,458 | A | 7/1985 | Johnson | |
| 4,574,685 | A | 3/1986 | Sanborn et al. | |
| 4,576,085 | A | 3/1986 | LeBlanc | |
| 4,579,036 | A | 4/1986 | LeBlanc | |
| 4,583,444 | A | 4/1986 | Jackson | |
| 4,970,938 | A | 11/1990 | Allais et al. | |
| 6,101,917 | A | 8/2000 | Klatte et al. | |
| 8,646,374 | B2 * | 2/2014 | Shacklee | F41A 23/24 89/41.02 |
| 9,746,270 | B1 * | 8/2017 | Rose | F41A 27/28 |
| 2015/0267989 | A1 * | 9/2015 | Hobson | F41A 23/24 89/37.12 |

* cited by examiner

DRIVE MECHANISM AND SYSTEM FOR REMOTELY OPERATING A TURRET

CROSS-REFERENCE TO RELATED APPLICATIONS

This application is a division of U.S. application Ser. No. 14/296,381 filed Jun. 4, 2014, now U.S. Pat. No. 9,746,270 issued Aug. 29, 2017, the entirety of which is incorporated by reference.

FIELD

The various embodiments relate generally to remote operation of one or more drive mechanisms and more specifically to manual remote operation of a turret-based drive mechanism from a vehicle chassis of a vehicle in a configuration where the drive mechanism is remote and inaccessible from within the vehicle chassis during operation of the vehicle.

BACKGROUND

An armored vehicle and tank commonly comprise a chassis on which is mounted a respective armored vehicle or tank turret rotatable relative to the armored vehicle chassis or tank chassis with a weapon disposed within the turret. They further comprise an azimuth and an elevation drive motor to, respectively, rotate the turret and elevate the weapon. In a typical manned turret an operator within the turret controls the drive motors.

In certain vehicles a turret ring gear is attached to the turret and thus rotates with the turret responsive to operator control of the azimuth motor.

In other vehicles the turret ring gear is affixed to the chassis. In this configuration the azimuth drive motor is disposed in and attached to (either directly or indirectly) the turret. The azimuth drive motor thus rotates with the turret. Therefore a manual crank in the chassis cannot be used to turn the azimuth motor and thus rotate the turret.

Additionally, advancements in armored vehicle design now provide the capability of completely unmanned turrets, where the azimuth drive motor and the elevation drive motor in the turret are controlled remotely by a vehicle operator from within the vehicle chassis. Remote control is accomplished by electrical power and control signals carried into the turret from the vehicle chassis via a slip-ring mounted at the center of rotation of the turret. Since the turret is unoccupied and closed-off from the vehicle chassis, these drive motors are not accessible by the vehicle operator during vehicle operation.

When turret power is lost, back up batteries are used to power back-up azimuth and elevation drive motors. Alternatively, when power is lost manual inputs to each drive motor permit operation by hand. In the case of a manned turret, an operator within the turret can manually control the azimuth and elevation drive motors under loss-of-power conditions. To effectuate this manual/mechanical operation, the turret operator attaches a shaft or crank to either or both of the manual motor inputs and manually turns the shaft or crank to rotate the motor. For an unmanned turret that is closed off from the vehicle chassis, the drive motors are inaccessible for manual operation by the vehicle operator within the chassis. Owners and operators of such vehicles with unmanned turrets would benefit from a system that allows for manual remote operation of a turret-based drive mechanism in a configuration where the drive mechanism is not accessible from within a vehicle chassis.

SUMMARY

An unmanned turret having a turret ring gear and first and second electrical force-producing devices with the unmanned turret being rotatably mounted to a vehicle chassis is disclosed. The turret drive mechanism comprising at least one ring gear independent of the turret ring gear. At least one manually-operable input component rotatably coupled to the at least one ring gear, the at least one input component accessible within the vehicle chassis is also provided. At least one output component mechanically coupled to at least one of the first and second electrical force-producing devices of the unmanned turret to cause rotation of the at least one of the first and second electrical force-producing device is also disclosed.

Another turret drive mechanism comprises a first ring gear independent of the turret ring gear and a second ring gear independent of the turret ring gear and arranged in a concentric relationship with the first ring gear. A first manually-operable input component rotatably coupled to the first ring gear, the first input component accessible within the vehicle chassis is also provided. A second manually-operable input component rotatably coupled to the second ring gear, the second input component accessible within the vehicle chassis is also provided. A first output component mechanically coupled to the first electrical force-producing device of the unmanned turret to cause rotation of the first electrical force-producing device and a second output component mechanically coupled to the second electrical force-producing device of the unmanned turret to causes rotation of the second electrical force-producing device and also provided.

An unmanned turret is disclosed comprising an unmanned turret drive system configured with a turret ring gear. The unmanned turret also comprises a remote turret drive system configured to interface with the unmanned turret drive system to control the unmanned turret drive system when at least one of electrical power and control signals is unavailable. The remote turret drive system is further configured with a first ring gear independent of the turret ring gear and a second ring gear independent of the turret ring gear and arranged in a concentric relationship with the first ring gear.

BRIEF DESCRIPTION OF THE DRAWINGS

The embodiments can be more easily understood and the further advantages and uses thereof more readily apparent, when considered in view of the following detailed description when read in conjunction with the following figures. In accordance with common practice, the various described features are not drawn to scale, but are drawn to emphasize specific features relevant to the embodiments. Reference characters denote like elements throughout the figures and text.

DETAILED DESCRIPTION

Figure 1:
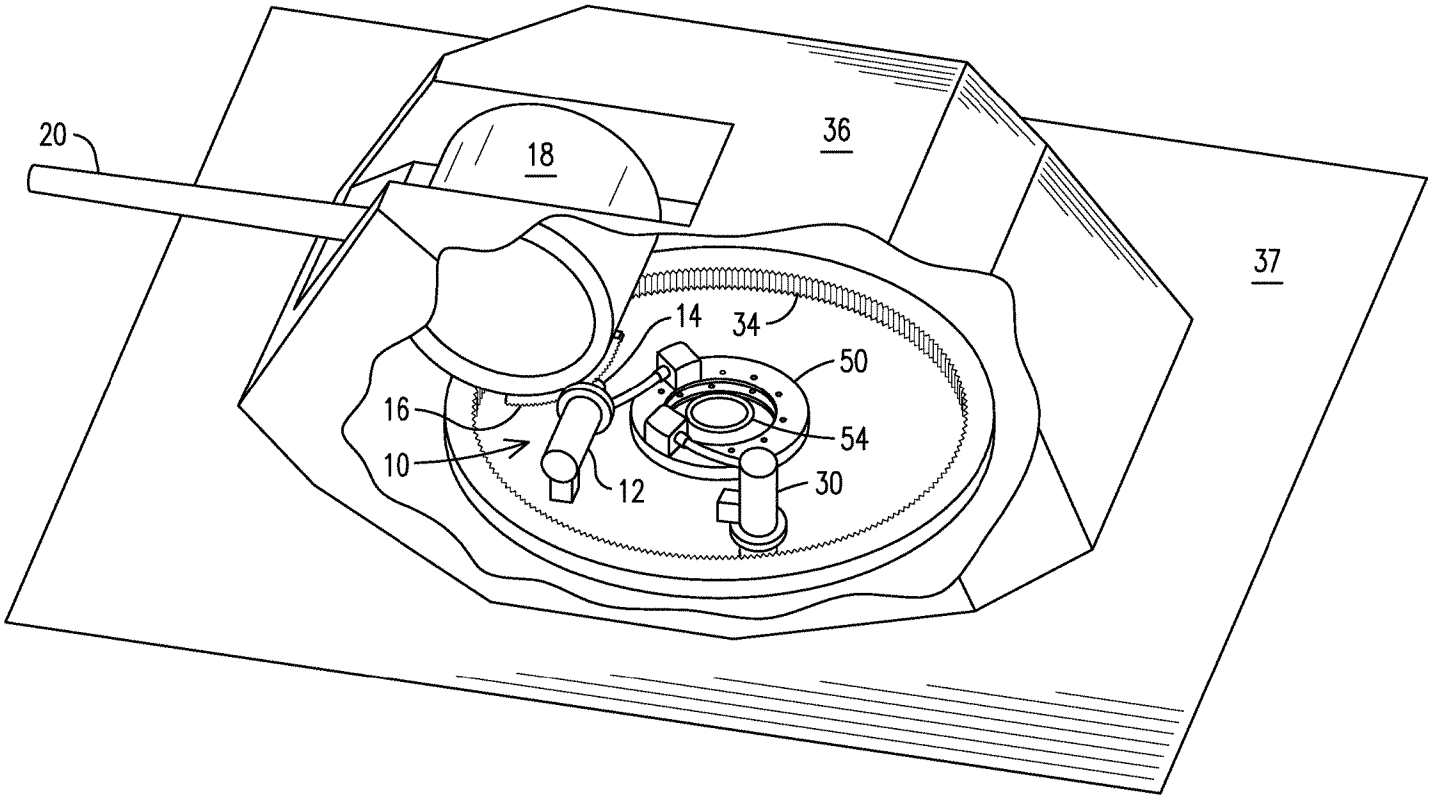
FIG. 1 is an orthogonal representation of an embodiment of a remote turret drive mechanism.

Embodiments are described with reference to the attached figures, wherein like reference numerals are used throughout the figures to designate similar or equivalent elements. The figures are not drawn to scale and they are provided merely to illustrate aspects disclosed herein. Several disclosed aspects are described herein with reference to example applications for illustration only. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. Disclosed embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope of the embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

A material of the various gears depicted in the Figures and described herein can be selected from materials conventionally used to manufacture gears, considering the torque that must be transferred through the interfacing gears to move the load.

As used herein the term "coupled" does not mean only directly connected, but also encompasses both direct connection of a first and second component and also connection of the first and second components through one or more intermediate linked connecting components.

As used herein, references to a component (the upper housing section 80 of FIG. 4, as a non-limiting example) that is attached to or affixed to the turret means the component is directly attached to the turret or the component is attached to another component that is attached to and rotates with the turret. Similarly, as used herein, references to a component (the lower housing section 90 of FIG. 5 as a non-limiting example) that is attached to or affixed to the vehicle chassis means the component is directly attached to the chassis or the component is attached to another component that is attached to the chassis.

As used herein, the phrase "rotatably coupled" is used to describe the configuration of at least two components where at least one component is configured to transmit kinetic energy to at least one other component. Such components can be directly attached, indirectly attached, directly interfacing, and/or indirectly interfacing, such as by meshing gears, direct drive or belt drive.

As used herein, the phrase "gearably coupled" refers to the meshing of geared teeth to allow a powered gear to drive a non-powered gear.

Embodiments of the remote turret drive mechanism describe a mechanically-linked mechanism that permits remote manual operation of one or both of elevation and azimuth motors disposed in the turret by the vehicle operator inside the vehicle chassis where a housing, compartment, seat, etc. is provided for locating the operator. Thus the mechanism is available when vehicle power or control has been lost.

In an embodiment, the remote turret drive mechanism comprises azimuth and elevation input components disposed in the vehicle. The mechanism further comprises azimuth and elevation output components in the turret that are connected to manual inputs of the motors in the turret. The elevation components raise and lower the weapon and the azimuth components rotate the turret. Thus the mechanism provides a small unmanned turret with the same capabilities as a large manned turret when power and/or control is lost within the turret, i.e., the vehicle operator can remotely operate the motors disposed in the turret from within the vehicle chassis.

Generally, the remote turret drive mechanism comprises two independent and manually operable input components (e.g., drive shafts) accessible by the vehicle operator (who is located within the vehicle chassis or more generally within an enclosure) at a fixed and non-rotating (relative to the vehicle chassis) location on a ceiling of the vehicle chassis. The remote turret drive mechanism transmits force separately from each of the manually operable input components in the vehicle through one or more rotatably-coupled assemblies to respective output components (e.g., drive shafts) in the turret (or in another enclosure).

In the turret a first output shaft is connected to a manual input coupler on an azimuth motor for rotating the turret. A second output shaft is connected to a manual input coupler on an elevation motor for raising or lowering the weapon. Whether operated manually, as described herein, or automatically responsive to control inputs, the azimuth motor and the elevation motor rotate with the turret.

The remote turret drive mechanism comprises a lower and an upper housing. The lower housing is fixed to the vehicle chassis and comprises the manually-operable azimuth and elevation input components that extend into the vehicle chassis. The upper housing, which comprises the azimuth and elevation output components, is fixed to the turret and rotates with the turret. The azimuth and elevation output components, which extend into the turret, are in turn connected to manual input couplers of the respective azimuth and elevation motors mounted in the turret.

Azimuth and elevation ring gears of the remote turret drive mechanism are located within a space between the upper and lower housings and supported by bearings described further below. The ring gears are rotatable relative to the housing in which they are disposed. The ring gears are not affixed to the upper or lower housings, to the chassis, nor to the turret, and are thus free to independently rotate. This configuration provides a rotating connection between the manually operable azimuth and elevation input components within the chassis and the azimuth and elevation output components within the turret. The output components are in turn each connected to a manual coupler on a respective azimuth drive motor and elevation drive motor, with both motors disposed within the turret. Use of the azimuth and elevation ring gears disposed within, but not affixed to the housings, allows rotation of the turret relative to the chassis during normal (i.e., powered) vehicle operation.

FIG. 1 generally illustrates various components of a turret 36 including a remote turret drive mechanism 10. An elevation drive motor 12 (also referred to as a force-producing device) affixed to the turret drives a pinion gear (or drive gear) 14 that in turn gearably drives a sector gear 16 affixed to a weapon platform 18. The weapon platform 18 carries a weapon 20 that is raised or lowered by controlling a rotational direction of the elevation drive motor 12.

Continuing with FIG. 1, a pinion gear (not visible in FIG. 1 and also referred to as a drive gear) is driven by an azimuth drive motor 30 (also referred to as a force-producing device) attached to the turret 36. The output pinion gear gearably drives a turret ring gear 34 affixed to a chassis 37. As the output pinion gear rotates in engagement with the turret ring gear 34, it rotates the turret 36 relative to the chassis 37. The azimuth drive motor 30 is controlled to impart clockwise or counterclockwise rotation to the turret 36 as the motor's output pinion gear orbits around the turret ring gear 34.

Since the both the elevation drive motor 12 and the azimuth drive motor 30 are affixed to the turret 36 they both rotate as the turret 36 rotates.

An interface assembly 50 is concentrically located relative to a slip ring assembly 54. Under normal operating conditions, the slip ring assembly 54 carries electrical power and control signals between the rotating turret 36 and the vehicle chassis 37. The slip ring assembly 54 is located at a center of rotation of the turret 36 relative to the chassis 37, as is the interface assembly 50. An upper portion of the slip ring assembly 54 rotates with the turret, while a lower portion is stationary on the chassis. Such slip ring assemblies are well known in the art.

In one embodiment the interface assembly 50 is mounted to or integrated with the slip ring assembly 54 to take advantage of the rotational interface that it provides between the turret and the chassis.

The interface assembly 50 links the fixed-location manually-operable azimuth and elevation input components (disposed on a ceiling of the vehicle chassis and not visible in FIG. 1) to the elevation and azimuth drive motors 12/30 in the rotating turret 36.

Figure 2:
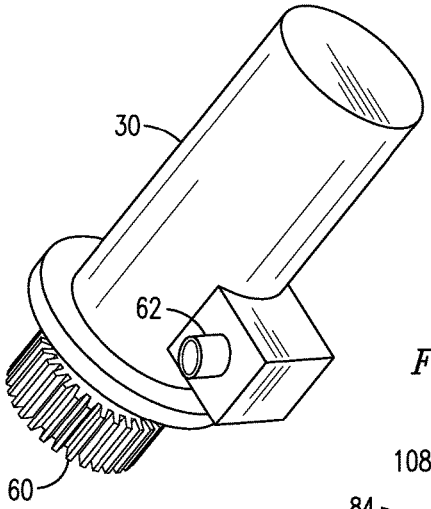
FIGS. 2 and 3 are orthogonal representations of an azimuth and elevation drive motor, respectively, of an embodiment of a remote turret drive mechanism.

FIG. 2 illustrates the azimuth drive motor 30 and a pinion gear (or drive gear) 60 that was not visible in FIG. 1. The pinion gear 60 meshes with the turret ring gear 34 of FIG. 1 to cause the turret 36 to rotate relative to the chassis 37. A manual azimuth input coupler 62 receives a shaft, crank, or another drive component for manually rotating the azimuth drive motor 30, as further described below.

Figure 3:
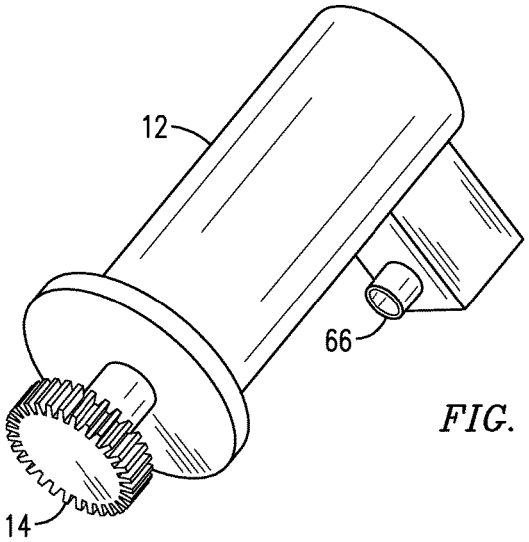

FIG. 3 illustrates the elevation drive motor 12 and the pinion gear 14 for driving the sector gear 16 of FIG. 1. A manual elevation input coupler 66 receives a shaft, crank, or similar drive component for manually rotating the elevation drive motor 12, as further described below.

Figure 4:
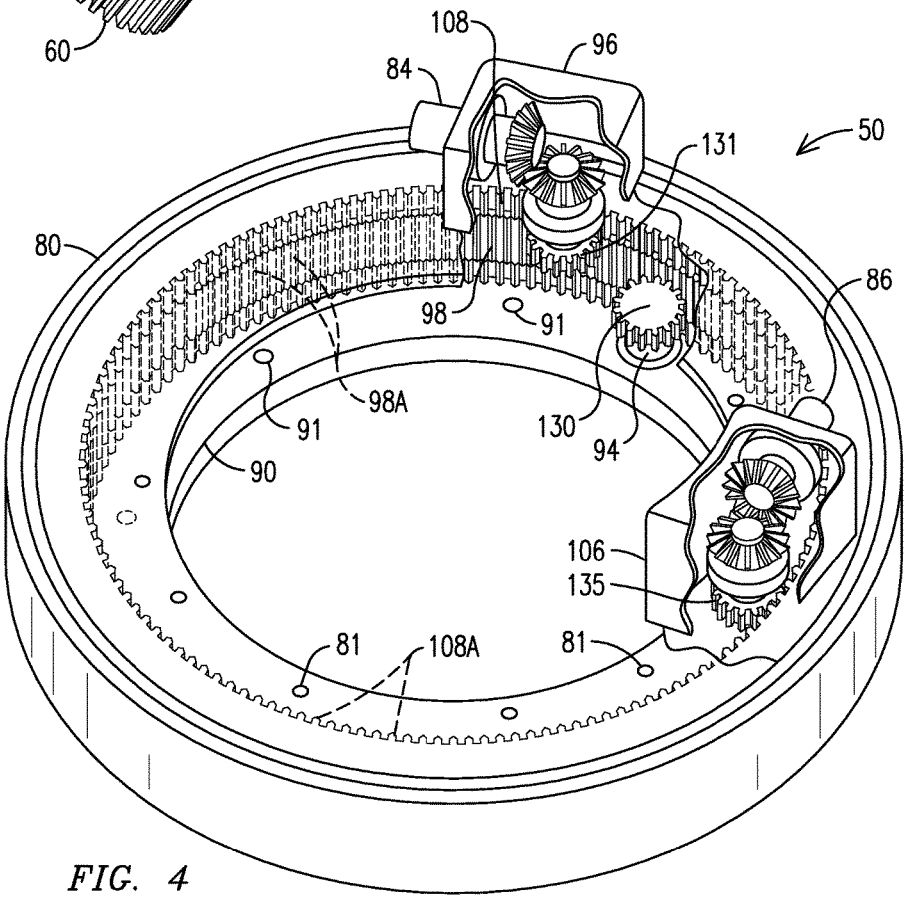
FIG. 4 is a top view of an embodiment of a remote turret drive mechanism.
Figure 5:
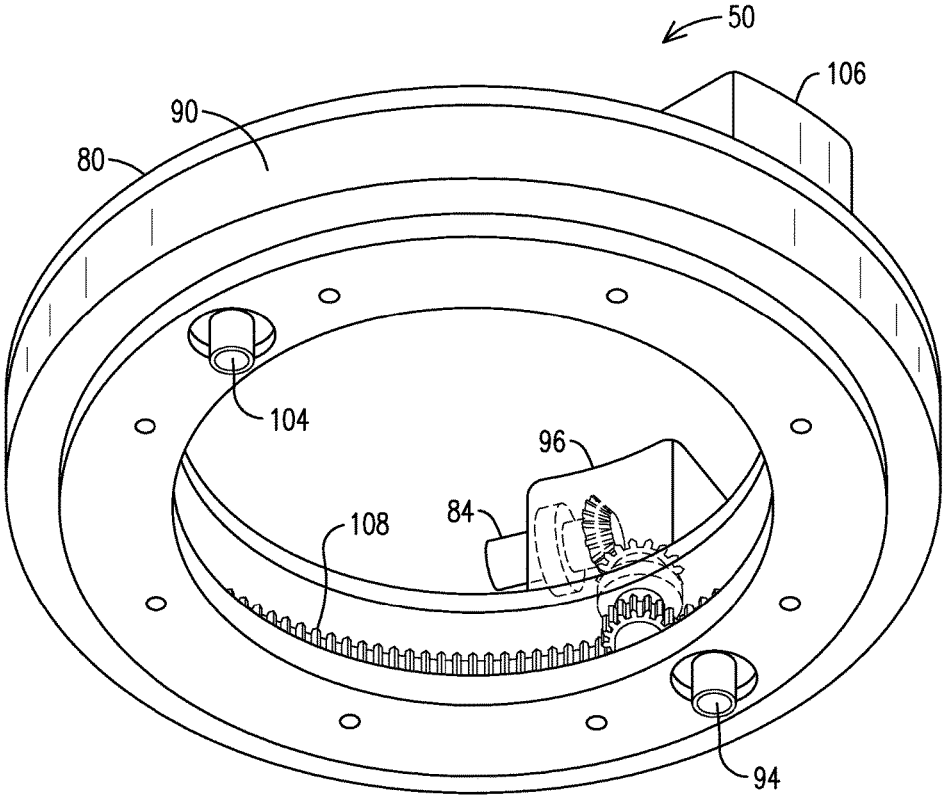
FIG. 5 is a bottom view of an embodiment of a remote turret drive mechanism.

FIGS. 4 and 5 illustrate upper and lower housings of the interface assembly 50 and their respective components as seen from above (FIG. 4) and as seen from below (FIG. 5).

FIG. 4 illustrates components of a upper housing section 80 and a lower housing section 90 as seen from within the turret 36 (i.e., from above). The upper housing section 80 is affixed to the turret, in a non-limiting example by the use of bolts and mating nuts disposed within openings 81. Since the azimuth and elevation gear assemblies located within housings 96 and 106 (the gears 138 and 134 within housing 96 and gears 144 and 154 within housing 106 are further described below and each also referred to as an output component for providing a mechanical output) protrude upwardly from the mating surface in which the openings 81 are defined, it may be desired to use a mounting flange attached to a lower surface of the turret (or in another embodiment to the slip ring) that defines openings or slots to provide clearance for the azimuth and elevation gear assemblies 96 and 106 to protrude into the turret. In another embodiment the attachment can be accomplished using multiple spaced-apart brackets (in a non-limiting example three brackets) attached around a perimeter of the upper housing section 80 and to a lower surface of the turret.

The lower housing section 90 is affixed to the vehicle chassis by the use of bolts and mating nuts within openings 91. Neither the bolts nor nuts are illustrated in FIG. 4. In another embodiment the lower housing section 90 is affixed to a lower half of the slip ring assembly 54.

The upper housing section 80 and the lower housing section 90 may be considered an interface housing having a first housing section configured to be mounted to the unmanned turret; and a second housing section configured to be mounted to the vehicle chassis such that the first housing section is rotatable with respect to the second housing section and the at least one manually-operable input component is accessible within the vehicle chassis.

FIG. 5 illustrates components of the lower housing section 90 and the upper housing section 80 as seen from within the vehicle chassis (i.e., from below). A manually-operable azimuth input drive component 94 (each also referred to as an input component for providing a mechanical input) extends from a lower surface of the lower housing section 90 and is accessible from within the vehicle chassis. The azimuth input drive component 94 has a fixed and non-rotating location on an upper surface or ceiling of the vehicle chassis. A crank, shaft, hand wheel, wrench or a similar drive component can be connected to the manually-operable azimuth input drive component 94. When power or control is lost within the turret the vehicle operator manually manipulates the crank, shaft, hand wheel, wrench etc., to rotate the azimuth input drive component 94, thereby rotating the azimuth output shaft 84 (see FIG. 4) by action of the intervening azimuth gear assembly 96 and an azimuth ring gear 98 (not visible in FIG. 5, but see FIGS. 4 and 6). Responsive to manual rotation of the azimuth input drive component 94 the turret rotates. These components are further described in detail below.

A manually-operable elevation input drive component 104 (also referred to as an input component) extends into the vehicle chassis from the lower housing section 90. The elevation input drive component 104 has a fixed and non-rotating location within the chassis. A crank, shaft, hand wheel, wrench or similar drive component can be connected to the elevation input drive component 104 for manual rotation by the vehicle operator. When power or control is lost in the turret the vehicle operator manually manipulates the crank, shaft, hand wheel, wrench, etc., rotating the elevation input drive component 104 to cause rotation of the elevation output shaft 86 (see FIG. 4) by action of an intervening elevation ring gear 108 and an elevation gear assembly 106. Responsive to manual rotation of the elevation input drive component 104 the weapon rotates up or down. These components are further described in detail below.

The azimuth ring gear 98 is arranged in a concentric relationship with the elevation ring gear 108. Each ring gear 98 and 108 is independent of the turret ring gear 34.

In FIG. 4 the azimuth and elevation gear assemblies 96 and 106 are depicted as separate components affixed to the upper housing section 80. However in another embodiment, an enclosure of both the azimuth and elevation gear assemblies 96 and 106 and the upper housing section 80 are fabricated as a single casting or machined part.

Note that as the turret 36 rotates relative to the chassis 37 (see FIG. 1) the manually-operable azimuth and elevation input drive components 94 and 104, respectively, remain at a fixed location within the vehicle chassis within easy reach of the vehicle operator. Components of the remote turret drive mechanism 10 mechanically link the input drive components 94 and 104 to the azimuth drive motor and the elevation drive motor 30 and 12 (see FIGS. 1 and 2) as follows. Manual rotation of the input drive components 94 and 104 by the operator in the chassis rotates the azimuth ring gear 98 and both the upper and lower segments 108A/108B of the elevation ring gear 108. See FIGS. 4 and 6. The upper and lower segments 108A/108B cooperate as described below.

The azimuth and elevation ring gears 98 and 108 gearably drive the respective azimuth and elevation gear assembly 96 and 106 (see FIGS. 4 and 5) that each in turn gearably drive and rotate their respective azimuth and elevation output shafts 84 and 86 (see FIG. 4). Lastly, the azimuth and elevation output shafts 84 and 86 are linked to the manual azimuth and elevation input couplers 62 and 66 of the respective azimuth and elevation drive motor 30 and 12 (see FIGS. 1, 2 and 3) for driving the motors 30 and 12.

The upper housing section 80 is attached to the turret as described above. Therefore when the turret rotates under powered or manual (i.e., by the operator in the chassis) conditions, the azimuth drive motor 30 and the elevation drive motors 12 (and their respective associated components), and the upper housing section 80 and its attached components (e.g., the azimuth and elevation gear assemblies 96 and 106) rotate with the turret. The components that rotate with the turret therefore maintain their respective positions relative to the other rotating components.

Figure 6:
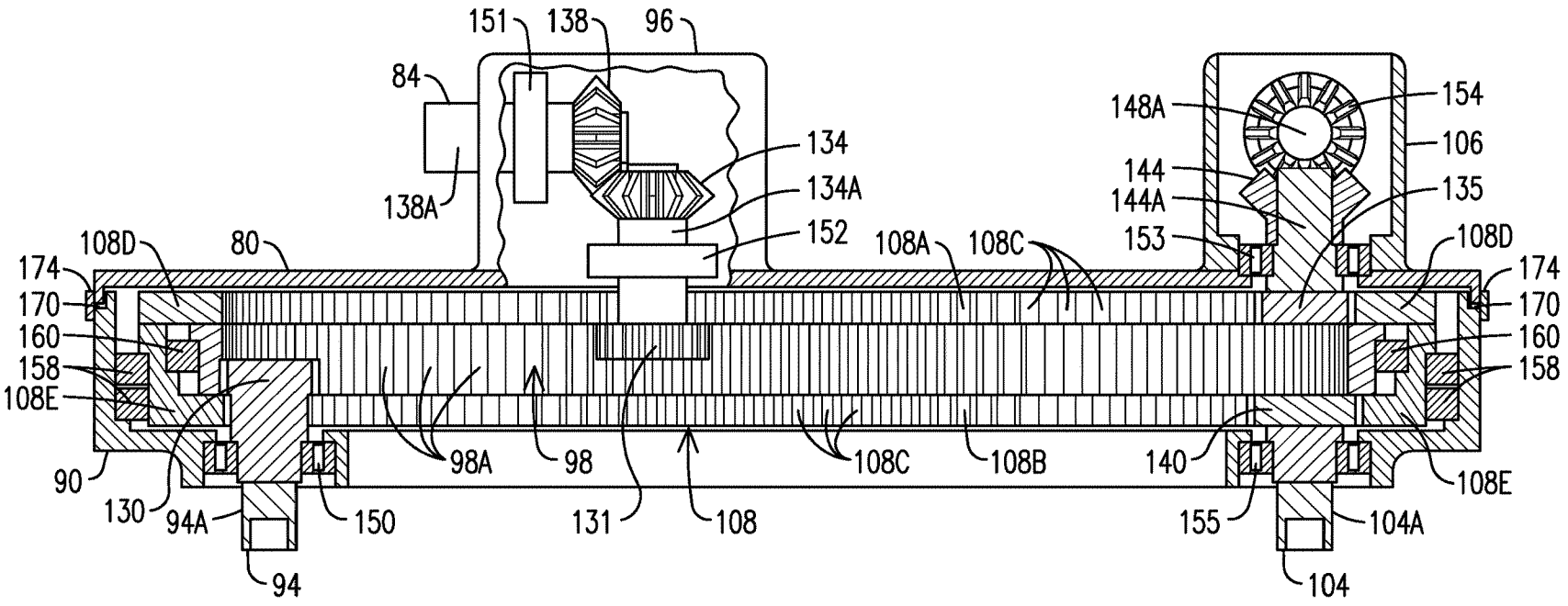
FIG. 6 is a detailed cross-section of the upper and lower housings of an embodiment of a remote turret drive mechanism.

Turning to the cross-sectional view of FIG. 6, it illustrates several of the aforementioned components and several additional components.

The manually-operable azimuth input drive component 94 comprises gear teeth 130 that mesh with gear teeth 98A of the azimuth ring gear 98. The gear teeth 98A are disposed on an inwardly-facing circumferential surface of the azimuth ring gear 98. See also FIG. 4. In another embodiment the azimuth input drive component 94 is connected to a separate gear comprising the gear teeth 130.

As the manually-operable azimuth input drive component 94 is rotated by the vehicle operator, the azimuth ring gear 98 rotates, rotating a gear 131 that in turn rotates a bevel gear 134 (also referred to as a miter gear 134 and substantially vertically oriented in one embodiment) in the azimuth gear assembly 96. Rotation of the bevel gear 134 rotates a mating bevel gear 138 (also referred to as a miter gear 138 and substantially horizontally oriented in one embodiment), which is connected to or forms the azimuth output shaft 84. Thus rotation of the fixed-location manually-operable azimuth input drive component 94 by the operator in the vehicle chassis is transferred to the azimuth output shaft 84.

Turning to the elevation drive as illustrated in FIG. 6, the manually-operable elevation input drive component 104 comprises gear teeth 140 that mesh with gear teeth 108C disposed on an inwardly-facing circumferential surface of the elevation ring gear 108 (which comprises upper and lower elevation ring gear segments 108A and 108B that rotate together). See also FIG. 4. In an alternative embodiment the elevation input drive component 104 is connected to a separate gear comprising the gear teeth 140.

As the manually-operable elevation input drive component 104 is rotated by the vehicle operator, the connected upper and lower segments 108A and 108B of the elevation ring gear 108 rotate, rotating a gear 135 that in turn rotates a bevel gear 144 (also referred to as a miter gear 144 and substantially vertically oriented in one embodiment) in the elevation gear assembly 106. Rotation of the bevel gear 144 rotates a bevel gear 148 (also referred to as a miter gear 138 and substantially horizontally oriented in one embodiment), which is connected to or forms the elevation output shaft 86 not visible in FIG. 6. Thus rotation of the fixed-location manually-operable elevation input drive component 104 by the operator in the vehicle chassis is transferred to the elevation output shaft 86 (see FIG. 4).

When power is available in the turret and the turret is rotated under power relative to the chassis, this rotation does not affect any components or operation of the remote turret drive mechanism.

The FIG. 6 cross-section also illustrates ring or sleeve bearings 150 that encircle a shaft 94A of the manually-operable azimuth input drive component 94; ring or sleeve bearings 151 that encircle a shaft 138A of the bevel gear 138; ring or sleeve bearings 152 that encircle a shaft 134A of the bevel gear 134; ring or sleeve bearings 153 that encircle a shaft 144A of the bevel gear 144; ring or sleeve bearings 154 that encircle a shaft 148A of the bevel gear 148; ring or sleeve bearings 155 that encircle a shaft 104A of the manually-operable elevation input drive component 104.

Reference character 108D of FIG. 6 designates a region of the upper segment 108A of the elevation ring gear 108, noting that FIG. 6 is a cross-sectional view. Similarly, reference character 108E of FIG. 6 designates a region of the lower ring gear segment 108B of the elevation ring gear 108. The region 108D is affixed to the region 108E, thereby attaching the upper segment 108A to the lower segment 108B.

Bearings 158 in FIG. 6 are disposed between the lower housing section 90 and an outwardly-facing side surface of the region 108E. A bearing 160 is disposed between the region 108E and the azimuth ring gear 98.

Assembly of the ring gears and their components proceeds as follows. The bearings 158 are set in place and the lower ring gear segment 108B of the elevation ring gear 108 is placed within the lower housing section 90. The bearing 160 is installed and the azimuth ring gear 98 is then dropped into place. The upper segment 108A of the elevation ring gear 108 is then set atop the azimuth ring gear 98 and the region 108D attached to the region 108E.

The upper and lower segments 108A/108B of the elevation ring gear 108 (see the cross-sectional view of FIG. 6) are not attached to the upper housing section 80 or lower housing section 90. Instead, the bearings 158 locate and support (by providing a bearing interface) the elevation ring gear 108 within the open space between the upper housing section 80 and lower housing section 90. The azimuth ring gear 98 is located and supported within the elevation ring gear 108 by the bearings 160.

Since the lower housing section 90 is attached to the vehicle chassis and the upper housing is attached to the turret, the lower housings section 90 and upper housing section 80 rotate relative to each other. In one embodiment bearing interfaces are present between these two housings. In an embodiment in which the remote turret drive mechanism 10 is integrated into the slip ring assembly 54, or housing, (see FIG. 1) internal bearing surfaces of the slip ring assembly serve to locate and provide a bearing interface between the upper and lower housings. The interface housing, as disclosed above, may be integrated with the slip ring housing 54.

A circumferential gap 170 between the upper housing section 80 and the lower housing section 90 can be sealed using any well-known materials and components. One non-limiting embodiment uses a wiping seal 174 to cover the gap and thereby prevent particulate matter and liquids from entering the gap 170.

Figure 7:
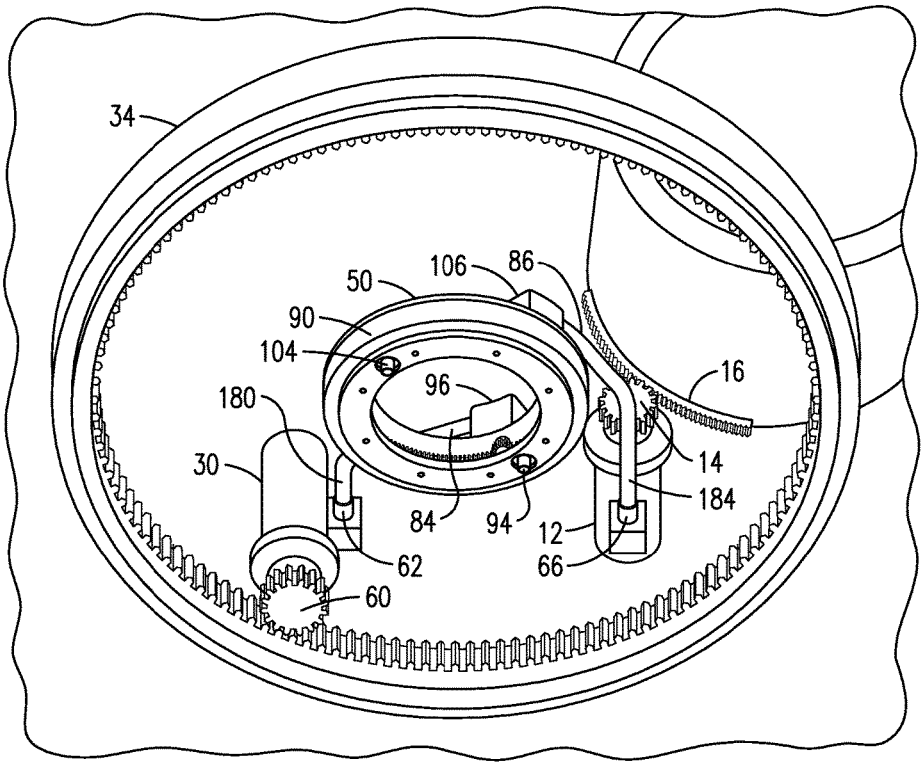
FIG. 7 is an orthogonal representation of the interface assembly of an embodiment of a remote turret drive mechanism.

To complete the mechanical link from the manually-operable azimuth input drive component 94 (see FIG. 5) to the manual azimuth input coupler 62 of the azimuth drive motor 30 (see FIG. 2), FIG. 7 further illustrates a flexible drive shaft 180 connected between the azimuth output shaft 84 and the azimuth input coupler 62.

FIG. 7 further illustrates a flexible drive shaft 184 connected between the elevation output shaft 86 and the manual elevation input coupler 66 of the elevation drive motor 12 (see FIG. 3) to complete the mechanical link from the manually-operable elevation input drive component 104 (see FIG. 5) to the elevation input coupler 66 of the elevation drive motor 12 (see FIG. 3).

Thus, as is discussed in detail above, the turret 36 has an unmanned turret drive system configured with the turret ring gear 34. A remote turret drive system is configured to interface with the unmanned drive system to control the unmanned turret drive system when power is removed from the unmanned drive system. The remote turret drive system is configured with a first ring gear (either the azimuth ring gear 98 or the elevation ring gear 108) which is independent of the turret ring gear 34 and a second ring gear (either the azimuth ring gear 98 or the elevation ring gear 108 based on which one is not the first ring gear) which is independent of the turret ring gear 34, and is arranged in a concentric relationship with the first ring gear.

The described configurations of the various components of the remote turret drive mechanism allow the turret to rotate relative to the vehicle chassis during normal vehicle operation (when power and control signals are available in the turret) while providing the vehicle operator in the chassis with convenient access to the manual inputs of the azimuth and elevation drives when power/control is not available in the turret.

While various disclosed embodiments have been described above, it should be understood that they have been presented by way of non-limiting examples only, and not limitation. Numerous changes to the subject matter disclosed herein can be made in accordance with the embodiments disclosed herein without departing from the spirit or scope of the embodiments. In addition, while a particular feature may have been disclosed with respect to only one of several implementations, such feature may be combined with one or more other features of the other implementations as may be desired and advantageous for any given or particular application.

Thus, the breadth and scope of the subject matter provided herein should not be limited by any of the above explicitly described embodiments. Rather, the scope of the embodiments should be defined in accordance with the following claims and their equivalents.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The embodiments herein specifically disclose an adjustable channel system for air conditioning line sets. Additionally, the embodiments may be used for other devices or systems where an enclosed fixture which minimizes exposure to moisture and may be formed and disassembled with minimum use of tools.

Thus, while embodiments have been described with reference to various embodiments, it will be understood by those skilled in the art that various changes, omissions and/or additions may be made and equivalents may be substituted for elements thereof without departing from the spirit and scope of the embodiments. In addition, many modifications may be made to adapt a particular situation or material to the teachings of the embodiments without departing from the scope thereof. Therefore, it is intended that the embodiments not be limited to the particular embodiment disclosed as the best mode contemplated, but that all embodiments falling within the scope of the appended claims are considered.

What is claimed is:

1. An unmanned turret having an unmanned turret drive system comprising a turret ring gear and first and second electrical force-producing devices with the unmanned turret being rotatably mounted to a vehicle chassis wherein the unmanned turret drive system being powered by electrical power and controlled by a control signal, the unmanned turret comprising, a remote turret drive mechanism, the remote turret drive mechanism comprising:

a first ring gear independent of the turret ring gear;

a second ring gear independent of the turret ring gear and arranged in a concentric relationship with the first ring gear;

a first manually-operable input component rotatably coupled to the first ring gear, the first input component accessible within the vehicle chassis;

a second manually-operable input component rotatably coupled to the second ring gear, the second input component accessible within the vehicle chassis;

a first output component mechanically coupled to the first electrical force-producing device of the unmanned turret drive system to cause rotation of the first electrical force-producing device; and a second output component mechanically coupled to the second electrical force-producing device of the unmanned turret drive system to cause rotation of the second electrical force-producing device wherein the remote turret drive mechanism is interfaced with the unmanned turret drive system to manually control the unmanned turret drive system when at least one of the electrical power and the control signal is lost.

2. The unmanned turret of claim 1, wherein the first ring gear is an azimuth ring gear and the first electrical force-producing device by being rotated is configured to rotate the unmanned turret azimuthally.

3. The unmanned turret of claim 2, further comprising a weapon mount and the second electrical force-producing device, by being rotated, is configured to elevate and depress the weapon mount.

4. The unmanned turret of claim 1, further comprising a surface and an interface housing having a first housing section configured to be mounted to the surface; and a second housing section, the second housing section configured to be mounted to the vehicle chassis such that the first housing section is rotatable with respect to the second housing section and at least one of the first manually-operable input component and the second manually-operable input component is accessible within the vehicle chassis.

5. The unmanned turret of claim 4, wherein the interface housing is integrated with a slip ring housing.

6. The unmanned turret of claim 1, wherein each of the first output component and the second output component further comprises a gear assembly comprising a first gear rotatably coupled to a second gear.

7. The unmanned turret of claim 6, wherein the first gear comprises a vertically-oriented first miter gear and the second gear comprising a horizontally-oriented second miter gear.

8. The unmanned turret of claim 1, wherein each of the first input component and the second input component comprises an input drive shaft accessible within the vehicle chassis to attach a manually manipulated element for rotating the input drive shaft.

9. A remote turret drive mechanism for an unmanned turret powered by electrical power and controlled by a control signal, the remote turret drive mechanism comprising:

a first ring gear independent of a turret ring gear of the unmanned turret;

a second ring gear independent of the turret ring gear and arranged in a concentric relationship with the first ring gear;

a first manually-operable input component rotatably coupled to the first ring gear, the first input component accessible within a vehicle chassis to which the unmanned turret is rotatably mounted;

a second manually-operable input component rotatably coupled to the second ring gear, the second input component accessible within the vehicle chassis;

a first output component mechanically coupled to a first electrical force-producing device of the unmanned turret and to the first input component to cause rotation of the first electrical force-producing device in response to manual operation of the first manually-operable input component from within the vehicle chassis when at least one of the electrical power and the control signal is lost to the unmanned turret; and a second output component mechanically coupled to a second electrical force-producing device of the unmanned turret and to the second input component to cause rotation of the second electrical force-producing device in response to manual operation of the second manually-operable input component when at least one of the electrical power and the control signal is lost to the unmanned turret.

10. The remote turret drive mechanism of claim 9, wherein:

the first electrical force-producing device is configured to rotate the unmanned turret azimuthally;

the first ring gear is an azimuth ring gear; and the second ring gear is an elevation ring gear.

11. The remote turret drive mechanism of claim 10, wherein the unmanned turret further comprises a weapon mount wherein rotation of the second electrical force-producing device is configured to elevate and depress the weapon mount.

12. The remote turret drive mechanism of claim 9, further comprising an interface housing having a first housing section configured to be mounted to a surface of the unmanned turret; and a second housing section, the second housing section configured to be mounted to the vehicle chassis such that the first housing section is rotatable with respect to the second housing section and at least one of the first manually-operable input component and the second manually-operable input component is accessible within the vehicle chassis wherein the first ring gear and the second ring gear are within the interface housing.

13. The remote turret drive mechanism of claim 12, wherein the interface housing is integrated with a slip ring housing of a slip ring assembly which carries the electrical power and the control signal between the unmanned turret and the vehicle chassis wherein the remote turret drive mechanism causes manual operation of the first and second electrical force-producing devices when at least one of the electrical power and the control signal is lost.

14. The remote turret drive mechanism of claim 9, wherein:

the first output component further comprising a first gear assembly mechanically coupled between the first ring gear and the first electrical force-producing device; and the second output component further comprising a second gear assembly mechanically coupled between the second ring gear and the second electrical force-producing device.

15. The remote turret drive mechanism of claim 14, wherein the first gear assembly comprising a vertically-oriented miter gear and a horizontally-oriented miter gear interfaced together.

16. The remote turret drive mechanism of claim 9, wherein each of the first input component and the second input component comprises an input drive shaft accessible within the vehicle chassis to attach a manually manipulated element for rotating the input drive shaft.

* * * * *